US008744307B2

(12) United States Patent
Watanabe

(10) Patent No.: US 8,744,307 B2
(45) Date of Patent: Jun. 3, 2014

(54) PROCESS CARTRIDGE AND IMAGE FORMING APPARATUS

(75) Inventor: Kaoru Watanabe, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 89 days.

(21) Appl. No.: 13/345,440

(22) Filed: Jan. 6, 2012

(65) Prior Publication Data

US 2012/0275821 A1 Nov. 1, 2012

(30) Foreign Application Priority Data

Apr. 26, 2011 (JP) ..... 2011-098169

(51) Int. Cl.
*G03G 21/18* (2006.01)

(52) U.S. Cl.
USPC ..... 399/111; 399/360

(58) Field of Classification Search
USPC ..... 399/112–114, 120, 358, 360
See application file for complete search history.

(56) References Cited

U.S. PATENT DOCUMENTS

| | | | | |
|---|---|---|---|---|
| 5,848,342 | A * | 12/1998 | Tanda | 399/358 |
| 5,852,762 | A * | 12/1998 | Hatta et al. | 399/358 |
| 6,792,230 | B2 * | 9/2004 | Saito et al. | 399/111 |
| 7,228,089 | B2 * | 6/2007 | Saito et al. | 399/107 |
| 7,873,308 | B2 * | 1/2011 | Saito et al. | 399/263 |
| 8,121,524 | B2 * | 2/2012 | Sakoh et al. | 399/262 |
| 2004/0047651 | A1 | 3/2004 | Koyama et al. | |
| 2006/0216083 | A1 * | 9/2006 | Okoshi | 399/350 |

FOREIGN PATENT DOCUMENTS

| | | |
|---|---|---|
| JP | 6-83191 A | 3/1994 |
| JP | 9-197931 A | 7/1997 |

OTHER PUBLICATIONS

Australian Office Action issued in counterpart Australian Patent Application No. 2012200245 dated Nov. 20, 2013.

* cited by examiner

*Primary Examiner* — David Gray
*Assistant Examiner* — Carla Therrien
(74) *Attorney, Agent, or Firm* — Sughrue Mion, PLLC

(57) ABSTRACT

A process cartridge includes an image forming unit including an image carrier, a developing unit, and a cleaning unit, the image carrier carrying a latent image and a toner image formed by developing the latent image with toner, the image carrier transferring the toner image onto a transfer body, the developing unit forming the toner image by developing the latent image with the toner, the cleaning unit cleaning the image carrier by removing the toner that remains on the image carrier; a container attachment unit that is provided at a position separated from the image forming unit and to which a toner container is detachably attached, the toner container containing the toner to be supplied to the developing unit; and a toner receiving unit that extends in a space between the image forming unit and the container attachment unit and receives the toner removed from the image carrier.

11 Claims, 11 Drawing Sheets

PROCESS CARTRIDGE AND IMAGE FORMING APPARATUS

CROSS-REFERENCE TO RELATED APPLICATIONS

This application is based on and claims priority under 35 USC 119 from Japanese Patent Application No. 2011-098169 filed Apr. 26, 2011.

BACKGROUND

The present invention relates to a process cartridge and an image forming apparatus.

SUMMARY

According to an aspect of the invention, there is provided a process cartridge including an image forming unit including an image carrier, a developing unit, and a cleaning unit, a container attachment unit, and a toner receiving unit. The image carrier carries a latent image formed by an exposure process and a toner image formed by developing the latent image with toner and transfers the toner image onto a transfer body. The developing unit forms the toner image on the image carrier by developing the latent image on the image carrier with the toner. The cleaning unit cleans the image carrier by removing the toner that remains on the image carrier after the toner image is transferred onto the transfer body. The container attachment unit is provided at a position separated from the image forming unit and to which a toner container is detachably attached, the toner container containing the toner to be supplied to the developing unit. The toner receiving unit extends in a space between the image forming unit and the container attachment unit and receives the toner removed from the image carrier by the cleaning unit.

BRIEF DESCRIPTION OF THE DRAWINGS

An exemplary embodiment of the present invention will be described in detail based on the following figures, wherein.

DETAILED DESCRIPTION

An exemplary embodiment of the present invention will be described with reference to the drawings.

Overall Structure of Image Forming Apparatus

Figure 1:
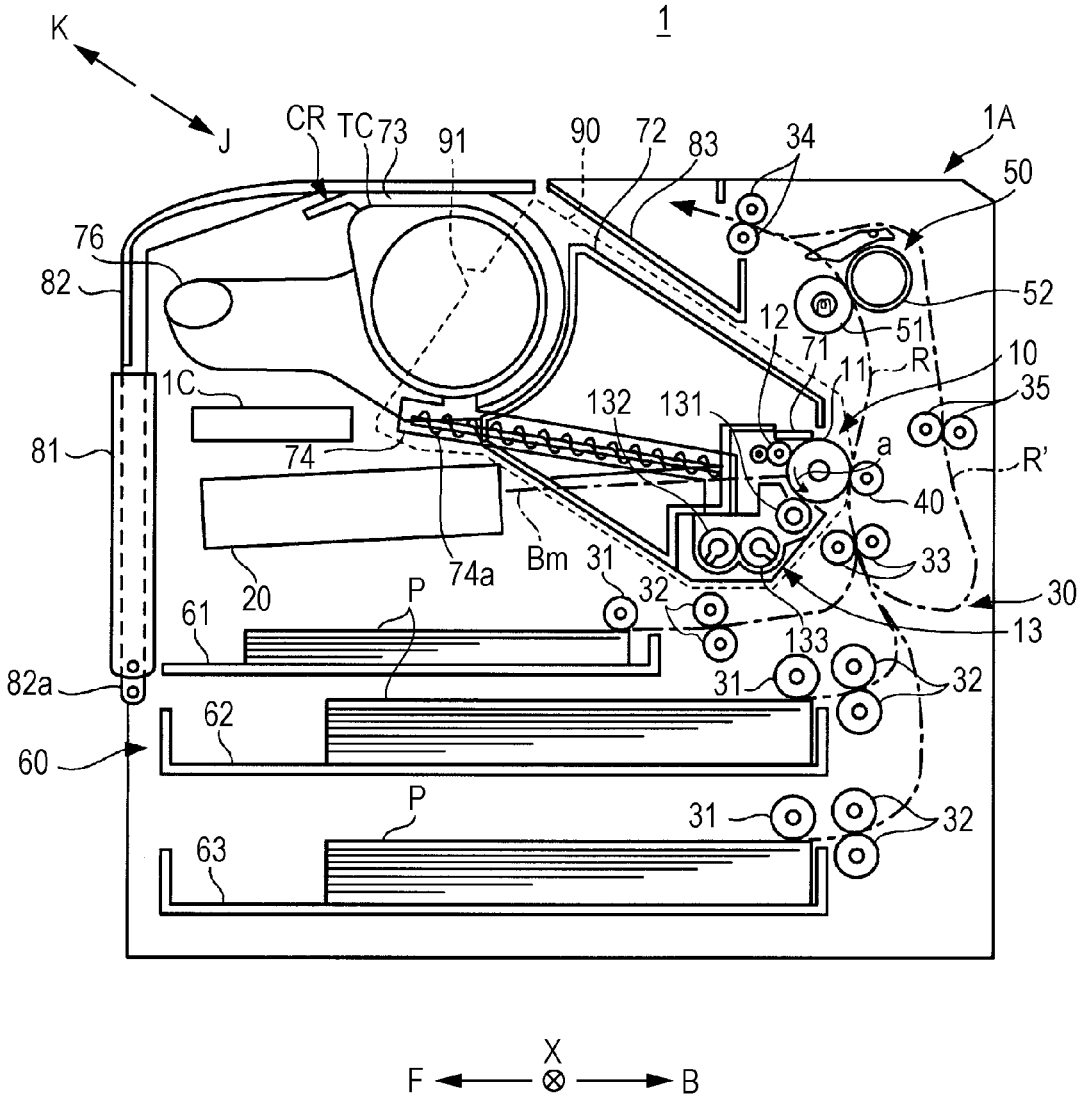
FIG. 1 is a schematic sectional view illustrating the structure of an image forming apparatus according to an exemplary embodiment of the present invention.
Figure 2:
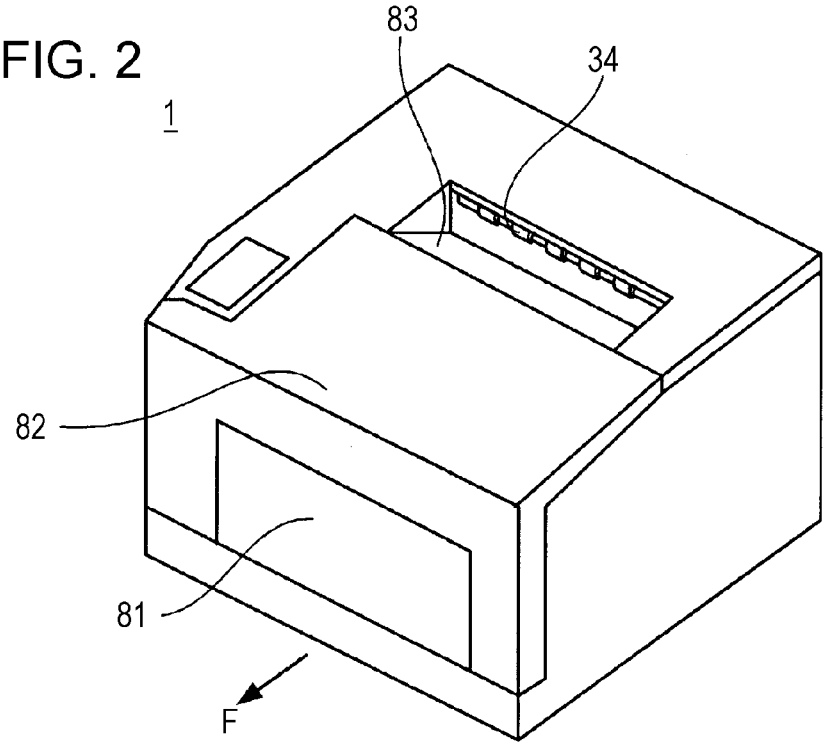
FIG. 2 is a perspective view illustrating the external appearance of the image forming apparatus illustrated in FIG. 1.

FIG. 1 is a schematic sectional view illustrating the structure of an image forming apparatus 1 according to an exemplary embodiment of the present invention. FIG. 2 is a perspective view illustrating the external appearance of the image forming apparatus 1 illustrated in FIG. 1.

The image forming apparatus 1 illustrated in FIGS. 1 and 2 is a printer that prints an image on a sheet of paper by an electrophotographic method. The image forming apparatus 1 includes a toner-image forming unit 10, an exposure device 20, a sheet-transporting device 30, a transferring device 40, a fixing device 50, and a sheet-storing section 60. The toner-image forming unit 10 includes a photoconductor 11, a charging device 12, and a developing device 13.

The photoconductor 11 has a cylindrical surface, and rotates in a direction shown by arrow a around an axis of the cylindrical surface. The photoconductor 11 carries an electrostatic latent image and a toner image formed on the surface thereof. The charging device 12 charges the surface of the photoconductor 11. In the illustrated example, the charging device 12 is a charging roller that rotates while being in contact with the photoconductor 11. As another example, a non-contact corotron charging device may be used.

The exposure device 20 exposes the photoconductor 11 to light to form an electrostatic latent image on the photoconductor 11. The exposure device 20 scans the surface of the photoconductor 11, charged by the charging device 12, with a light beam Bm based on an image signal supplied from an external device. Thus, a latent image is formed on the surface of the photoconductor 11. The exposure device 20 scans the surface of the photoconductor 11 with the light beam Bm in an axial direction X in which the rotational axis of the photoconductor 11 extends.

The developing device 13 develops the latent image on the photoconductor 11 with toner, thereby forming a toner image on the photoconductor 11. The developing device 13 includes stirring members 132 and 133 for stirring developer including the toner and magnetic carrier and a developing roller 131 that transports the developer that has been stirred to the photoconductor 11.

The transferring device 40 is a roller that rotates while a sheet of paper is interposed between the photoconductor 11 and the roller. The transferring device 40 transfers the toner image on the photoconductor 11 onto the sheet of paper. The fixing device 50 fixes the toner image that has been transferred onto the sheet of paper from the photoconductor 11 to the sheet of paper. The fixing device 50 includes a heating roller 51 and a pressing roller 52, and heats and pressurizes the toner by causing the sheet of paper on which the toner image is formed in an unfixed state to pass between the heating roller 51 and the pressing roller 52.

The sheet-storing section 60 contains sheets of paper on which images may be formed. The sheet-storing section 60 includes three sheet containers 61, 62, and 63 for containing three types of sheets. Of the three sheet containers 61 to 63, the two sheet containers 62 and 63 disposed in a lower section may be pulled out by an operator in a forward direction F from the front surface of the image forming apparatus 1. The operator supplies sheets of paper to the sheet containers 62 and 63 and pushes the sheet containers 62 and 63 into the image forming apparatus 1 in a rearward direction B. Accordingly, images may be formed on the sheets of paper. The sheet container 61, which is the remaining one of the three sheet containers 61 to 63 that is disposed in an upper section, is externally exposed at the front side of the image forming apparatus 1 when a manual-feed door 81 provided at the front surface of the image forming apparatus 1 is opened in the forward direction F. In this state, sheets of paper are supplied to the sheet container 61.

The sheet-transporting device 30 transports each sheet of paper along a transporting path R that passes through a transfer position. The transfer position is a position at which the toner image is transferred onto the sheet of paper from the photoconductor 11, and is located between the photoconductor 11 and the transferring device 40. The sheet-transporting device 30 includes pickup rollers 31, separation rollers 32, registration rollers 33, output rollers 34, and reverse transport rollers 35. The pickup rollers 31 pick up the sheets of paper from the sheet containers 61 to 63. The separation rollers 32 separate the sheets of paper picked up by the pickup rollers 31 from each other. The registration rollers 33 feed each sheet of paper to the transferring device 40 in accordance with the time at which the toner image is formed on the photoconductor 11. The output rollers 34 output the sheet of paper to which the toner image is fixed by the fixing device 50 to the outside of the image forming apparatus 1. The sheet of paper output by the output rollers 34 is placed on an output table 83 provided in an upper section of the image forming apparatus 1. A part of the output sheet that protrudes from the output table 83 is placed on a door panel 82. The door panel 82 is a component that covers the front side and the top side of the image forming apparatus 1. When the door panel 82 is rotated in the forward direction F around a shaft 82*a* provided at the front side of the image forming apparatus 1, the internal mechanism of the image forming apparatus 1 is exposed. In the case where duplex printing is performed, the output rollers 34 rotate in the reverse direction after transporting the sheet of paper to an intermediate position, and transport the sheet of paper along a reverse transporting path R'. The reverse transport rollers 35 transport the sheet of paper along the reverse transporting path R' to the registration rollers 33. Accordingly, an image is formed on a surface of the sheet of paper at the side opposite to the side at which an image is already formed.

In the image forming apparatus 1 according to the present exemplary embodiment, the sheets of paper are supplied from the front of the image forming apparatus 1. In the image forming apparatus 1, sheets of paper P are supplied to the sheet containers 61 to 63 from a position in front of the image forming apparatus 1 in the forward direction F, and are transported in a rear section of the image forming apparatus 1. More specifically, the sheets of paper P are transported upward along the transporting path R provided behind the photoconductor 11 in the rearward direction B. The sheets of paper P on which the images are formed are ejected in the forward direction F and stacked on the output table 83 in the upper section of the image forming apparatus 1. The operator supplies new sheets of paper to the image forming apparatus 1 and takes out the sheets of paper on which the images are formed while being at a position in front of the image forming apparatus 1 in the forward direction F. Therefore, the image forming apparatus 1 may be placed at a position where there is no large space at either side of the image forming apparatus 1 in the axial direction X. An image reading device may be provided above the image forming apparatus 1 with a space therebetween for allowing the sheets of paper to be taken out and allowing components to be replaced. As described below, processes of attaching and detaching a process cartridge CR and a toner container TC to/from the image forming apparatus 1 are also performed while the operator is at a position in front of the image forming apparatus 1 in the forward direction F.

The image forming apparatus 1 also includes a cleaning device 71, a collected-toner receiving box 72, a container attachment unit 73, a toner supplier 74, and a controller 1C.

The cleaning device 71 comes into contact with the photoconductor 11 and cleans the photoconductor 11 by removing the toner that remains on the photoconductor 11 after the toner image is transferred onto a sheet of paper. The cleaning device 71 is a plate-shaped blade that extends along the photoconductor 11. The collected-toner receiving box 72 contains the toner that is removed from the photoconductor 11 by the cleaning device 71. The toner container (toner cartridge) TC is detachably attached to the container attachment unit 73. The toner container TC contains the toner to be supplied to the developing device 13. When the toner runs out, the operator takes out the toner container TC and replaces it with a new toner container TC.

The toner supplier 74 supplies the toner contained in the toner container TC to the developing device 13. The toner supplier 74 includes a tube that extends from a position below the toner container TC to a position above the developing device 13 and a helical blade member 74*a* placed in the tube. The toner supplier 74 transports the toner from the toner container TC to the developing device 13 by rotating the blade member 74*a*. The controller 10 controls each part of the image forming apparatus 1.

The above-described toner-image forming unit 10, the cleaning device 71, the collected-toner receiving box 72, the container attachment unit 73, and the toner supplier 74 are provided in the process cartridge CR. The process cartridge CR is detachably attached to an apparatus body 1A of the image forming apparatus 1. The toner container TC is detachably attached to the process cartridge CR. Here, the direction in which the process cartridge CR is attached to the apparatus body 1A is referred to as an attachment direction J, and the direction opposite to the attachment direction J is referred to as a detachment direction K. The attachment direction J and the detachment direction K are generically referred to as an attachment-detachment direction JK. The process cartridge CR has a handle 76 to be grasped by the operator when the operator attaches or detaches the process cartridge CR to/from the apparatus body 1A. The detailed structure of the process cartridge CR will be described below.

Here, the process cartridge CR corresponds to an exemplary embodiment of the present invention, and the toner-image forming unit 10 corresponds to an example of an image forming unit according to an exemplary embodiment of the present invention. The photoconductor 11 corresponds to an example of an image carrier according to an exemplary embodiment of the present invention, and the exposure device 20 corresponds to an example of an exposure unit according to an exemplary embodiment of the present invention. The developing device 13 corresponds to an example of a developing unit according to an exemplary embodiment of the present invention, and the sheet-transporting device 30 corresponds to an example of a transporting unit according to an exemplary embodiment of the present invention. The cleaning device 71 corresponds to an example of a cleaning unit according to an exemplary embodiment of the present invention, and the collected-toner receiving box 72 corresponds to an example of a toner receiving unit according to an exemplary embodiment of the present invention.

Basic Operation of Image Forming Apparatus

The basic operation of the image forming apparatus 1 illustrated in FIG. 1 will now be described. In the toner-image forming unit 10, the photoconductor 11 is rotated in the direction shown by arrow a, and the surface of the photoconductor 11 is charged with electricity by the charging device 12. The exposure device 20 irradiates the surface of the photoconductor 11 with exposure light based on the image signal supplied from the external device. Accordingly, an electrostatic latent image is formed on the surface of the photoconductor 11. The photoconductor 11 rotates while carrying the electrostatic latent image.

The developing device 13 forms a toner image by developing the electrostatic latent image on the photoconductor 11 with the toner. The toner is supplied to the developing device 13 from the toner container TC by the toner supplier 74. The photoconductor 11 rotates while carrying the toner image formed by the developing device 13.

The sheets of paper P contained in the sheet containers 61 to 63 are picked up by the pickup rollers 31 and are transported toward the transferring device 40 along the transporting path R by the separation rollers 32 and the registration rollers 33. Each sheet of paper P is fed toward the transferring device 40 by the registration rollers 33 in accordance with the time at which the toner image is formed on the photoconductor 11. The transferring device 40 applies a transferring bias voltage between the photoconductor 11 and the sheet of paper, so that the toner image on the photoconductor 11 is transferred onto the sheet of paper. The transferring device 40 transports the sheet of paper onto which the toner image has been transferred to the fixing device 50, where the toner image is fixed to the sheet of paper. Thus, an image is formed on the sheet of paper. The sheet of paper on which the image is formed is ejected onto the output table 83 by the output rollers 34.

After the transferring process is performed by the transferring device 40, the toner that remains on the photoconductor 11 is removed by the cleaning device 71. The toner removed from the photoconductor 11 by the cleaning device 71 is collected in the collected-toner receiving box 72.

Process Cartridge Attaching/Detaching Operation

Figure 3:
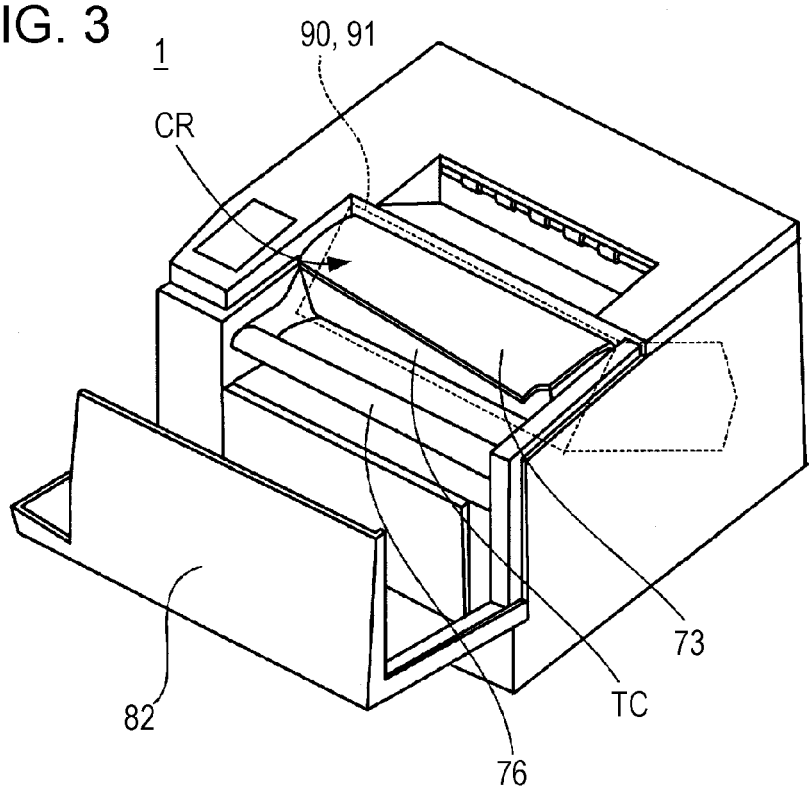
FIG. 3 is a perspective view illustrating the state in which a door panel of the image forming apparatus illustrated in FIG. 2 is opened.

FIG. 3 is a perspective view illustrating the state in which the door panel 82 of the image forming apparatus 1 illustrated in FIG. 2 is opened.

Referring to FIGS. 3 and 1, when the door panel 82 that covers the front and top sides of the image forming apparatus 1 is opened in the forward direction F, the process cartridge CR is externally exposed. More specifically, when the door panel 82 is opened, the container attachment unit 73, the toner container TC, and the handle 76 of the process cartridge CR are exposed. The process cartridge CR is placed in a hollow space provided in an attachment unit 90 of the apparatus body 1A. The hollow space in the attachment unit 90 has an attachment opening 91 that opens obliquely upward with respect to the forward direction F in the apparatus body 1A of the image forming apparatus 1.

Figure 4:
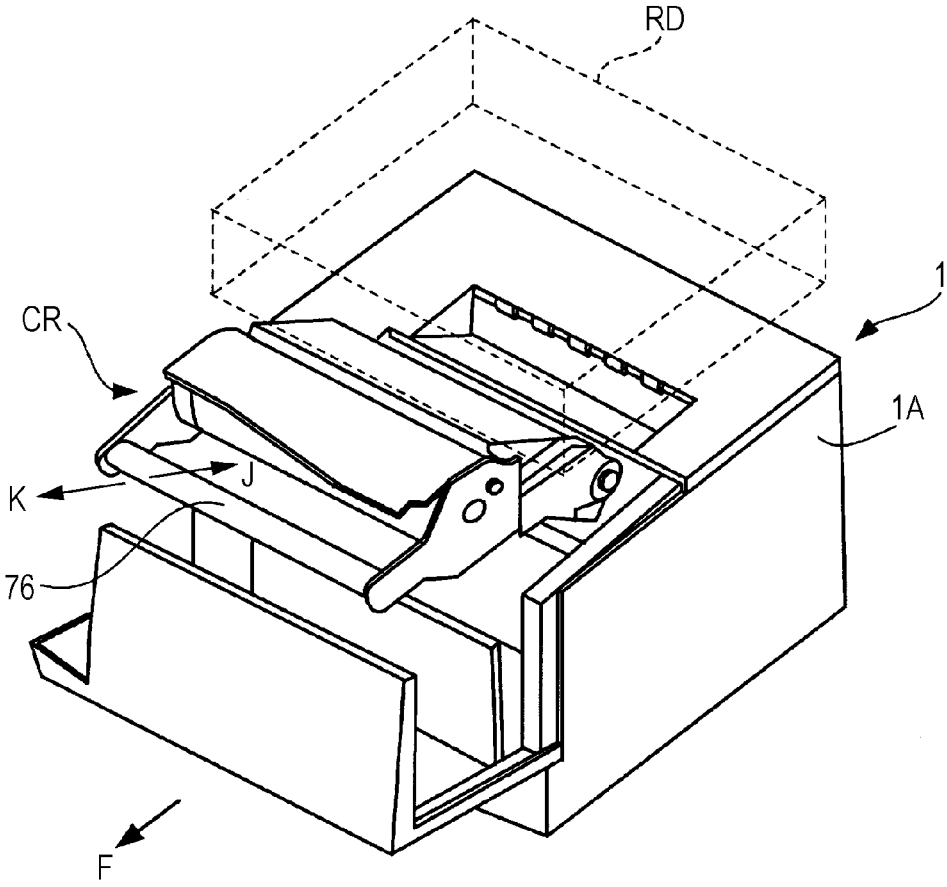
FIG. 4 is a perspective view illustrating an intermediate state of a process of taking out a process cartridge.

FIG. 4 is a perspective view illustrating an intermediate state of a process of taking out the process cartridge CR. In FIG. 4, the position at which an image reading device RD may be placed above the image forming apparatus 1 is shown by the dashed lines. The image reading device RD is a device for reading an image from a document. When data of the thus-read image is transmitted to the image forming apparatus 1, the image forming apparatus 1 functions as a copy machine.

When the operator grasps and pulls the handle 76, the process cartridge CR is pulled out from the apparatus body 1A of the image forming apparatus 1 obliquely upward with respect to the forward direction F, that is, in the detachment direction K. In the case where the image reading device RD is disposed above the image forming apparatus 1, a space through which the sheets of paper may be taken out is provided between the image forming apparatus 1 and the image reading device RD. When the process cartridge CR is attached to or detached from the image forming apparatus 1, the process cartridge CR is moved through the space that is provided between the image forming apparatus 1 and the image reading device RD for allowing the sheets of paper to be taken out.

Structure of Process Cartridge

Figure 5:
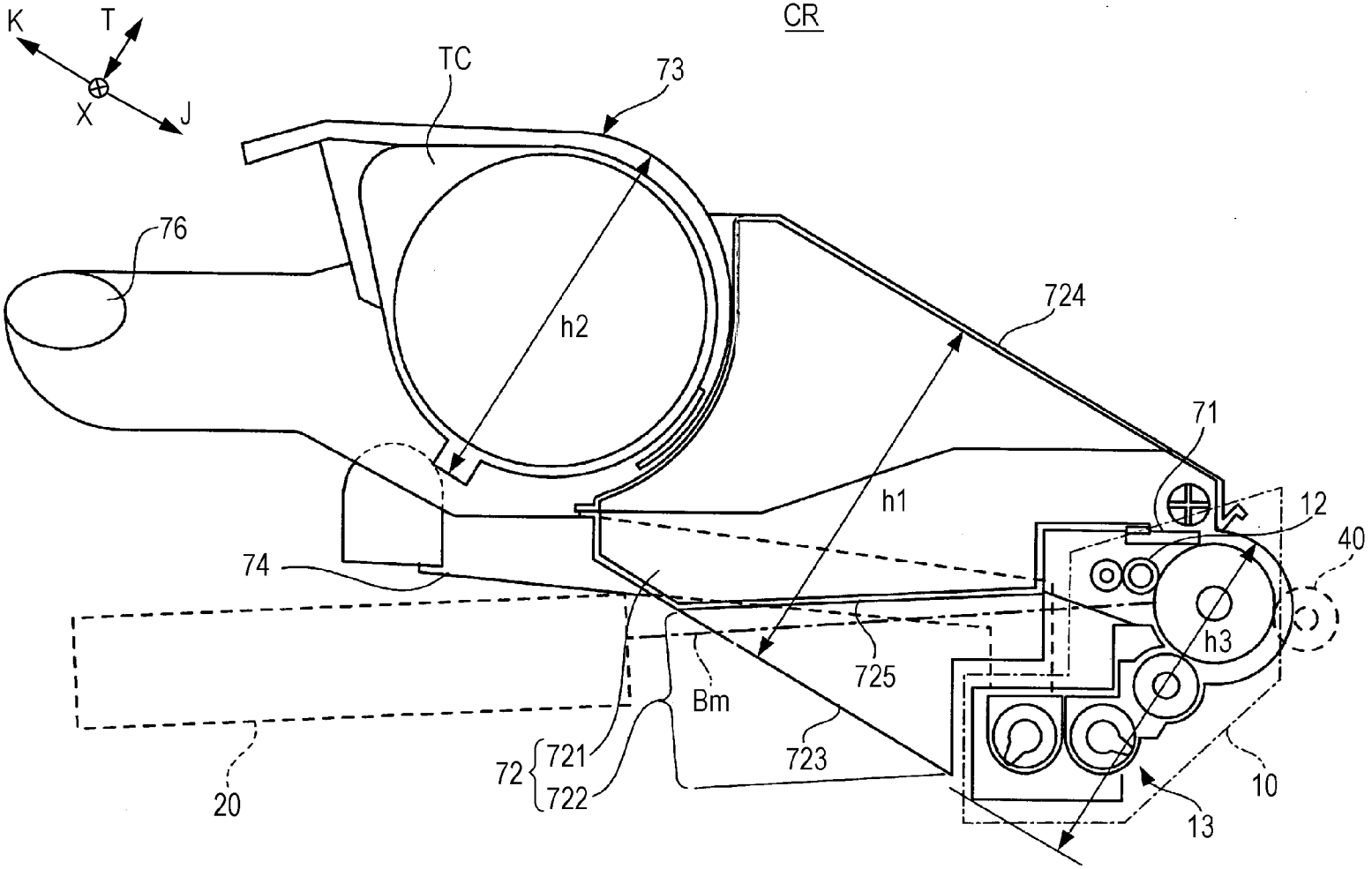
FIG. 5 is a sectional view illustrating the structure of the process cartridge.
Figure 6:
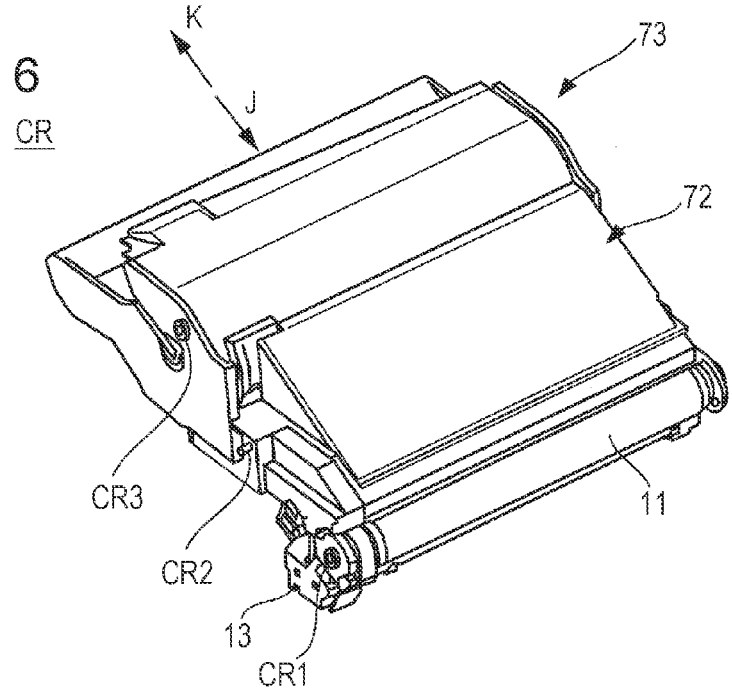
FIG. 6 is a perspective view illustrating the external appearance of the process cartridge.

FIG. 5 is a sectional view illustrating the structure of the process cartridge CR. FIG. 6 is a perspective view illustrating the external appearance of the process cartridge CR.

In FIG. 5, the positions of the exposure device 20 and the transferring device 40 in the state in which the process cartridge CR is attached to the apparatus body 1A (see FIG. 1) of the image forming apparatus 1 are shown by the dashed lines. FIG. 6 shows projections CR1, CR2, and CR3 used to position the process cartridge CR when the process cartridge CR is attached to the apparatus body 1A of the image forming apparatus 1.

The process cartridge CR is a replaceable unit in which the toner-image forming unit 10, the cleaning device 71, the collected-toner receiving box 72, the container attachment unit 73, the toner supplier 74, and the handle 76 are formed as a unit. The toner-image forming unit 10 includes the photoconductor 11, the charging device 12, and the developing device 13. Therefore, in the image forming apparatus 1 (see FIG. 1), when the process cartridge CR is replaced with a new one, all of the photoconductor 11, the charging device 12, the developing device 13, the cleaning device 71, and the collected-toner receiving box 72 are replaced with new ones. The toner container TC is detachably attached to the container attachment unit 73 included in the process cartridge CR. Therefore, the toner container TC may be detached from the container attachment unit 73 and replaced with a new one while the process cartridge CR is attached to the apparatus body 1A (see FIG. 1).

Arrangement of Collected-Toner Receiving Box

In the process cartridge CR illustrated in FIG. 5, the container attachment unit 73 to which the toner container TC is attached is not positioned next to the toner-image forming unit 10, but is separated from the toner-image forming unit 10. The collected-toner receiving box 72 extends over a space between the toner-image forming unit 10 and the container attachment unit 73.

Except for the collected-toner receiving box 72, the toner container TC and the toner-image forming unit 10 are the components that occupy the largest spaces in the process cartridge CR. Since the toner container TC and the toner-image forming unit 10 are separated from each other, a large space is provided between the toner container TC and the toner-image forming unit 10 without forming a projecting portion in the process cartridge CR. The collected-toner receiving box 72 extends over the space between the toner container TC and the toner-image forming unit 10. Therefore, compared to the case in which, for example, the toner container TC is disposed next to the toner-image forming unit and a collected-toner receiving box is arranged in a space between other components without forming a projecting portion in the process cartridge, the capacity of the collected-toner receiving box may be increased.

The collected-toner receiving box 72 becomes unusable when the toner cannot be fed into the collected-toner receiving box 72, that is, when the collected-toner receiving box 72 is full and the toner removed from the photoconductor 11 by the cleaning device 71 cannot be transported into the collected-toner receiving box 72. In this case, it is necessary to replace the process cartridge CR with a new one. Thus, the capacity of the collected-toner receiving box 72 is one of the factors that affect the life of the process cartridge CR. When the capacity of the collected-toner receiving box 72 is increased, the life of the process cartridge CR is increased accordingly.

In the process cartridge CR, the toner-image forming unit 10, the collected-toner receiving box 72, and the container attachment unit 73 are arranged in the attachment-detachment direction JK of the process cartridge CR. Therefore, when the process cartridge CR is attached to the apparatus body 1A (see FIGS. 1 and 3) or detached from the apparatus body 1A, the toner-image forming unit 10, the collected-toner receiving box 72, and the container attachment unit 73 pass through the attachment opening 91 (see FIGS. 1 and 3) in the attachment unit 90 of the apparatus body 1A successively instead of simultaneously. Therefore, the attachment opening 91 in the image forming apparatus 1 according to the present exemplary embodiment is smaller than that in the case in which, for example, the toner-image forming unit, the collected-toner receiving box, and the container attachment unit are not arranged in the attachment-detachment direction JK of the process cartridge but are arranged so as to overlap in a direction that crosses the attachment-detachment direction JK. In addition, the space required for the movement of the cartridge CR in the process of attaching or detaching the process cartridge CR to/from the apparatus body 1A is also small. For example, the space required for the movement of the process cartridge CR is substantially equivalent to the space required for the movement of the toner container TC in the process of attaching or detaching the toner container TC to/from the process cartridge CR. Therefore, the process cartridge CR may be attached to or detached from the image forming apparatus 1 by using the space illustrated in FIG. 4 that is provided between the image forming apparatus 1 and the image reading device RD for allowing the sheets of paper to be taken out and the toner container TC to be replaced with a new one.

As illustrated in FIG. 1, in the state in which the process cartridge CR is attached to the apparatus body 1A, the process cartridge CR is positioned such that the container attachment unit 73 is at the rear end thereof in the attachment direction J. In other words, in the state in which the process cartridge CR is attached to the apparatus body 1A, the container attachment unit 73 included in the process cartridge CR is positioned closest to the front side of the attachment unit 90 in the apparatus body 1A of the image forming apparatus 1. Therefore, when the door panel 82 of the apparatus body 1A is opened as illustrated in FIG. 3, the container attachment unit 73 included in the process cartridge CR and the toner container TC attached to the container attachment unit 73 are externally exposed. Accordingly, the toner container TC may be attached to or detached from the container attachment unit 73 without taking out the process cartridge CR from the image forming apparatus 1. Therefore, compared to the case in which, for example, the container attachment unit is at a position deeper than the collected-toner receiving box, the toner container TC may be more easily attached to or detached from the container attachment unit by the operator.

In addition, as illustrated in FIG. 1, the toner-image forming unit 10 including the photoconductor 11 is disposed in the image forming apparatus 1 at a position near the side in the rearward direction B, that is, at a position far from the operator. Here, since the container attachment unit 73 is positioned at the rear end in the attachment direction, the container attachment unit 73 and the toner container TC are disposed at the front area of the image forming apparatus 1, that is, near the side in the forward direction F. Therefore, although the collected-toner receiving box 72 having a large capacity is included in the process cartridge CR, the operator may attach or detach the toner container TC to/from the container attachment unit 73 while being at a position in front of the image forming apparatus 1 in the forward direction F, similar to the process of taking out the sheets of paper. When the collected-toner receiving box 72 is to be replaced, the process cartridge CR is pulled out through the attachment opening 91, similar to the process of taking out the toner container TC, and is replaced. The process of attaching the toner container TC to the container attachment unit 73 will be described below.

Shape of Collected-Toner Receiving Box

Figure 7:
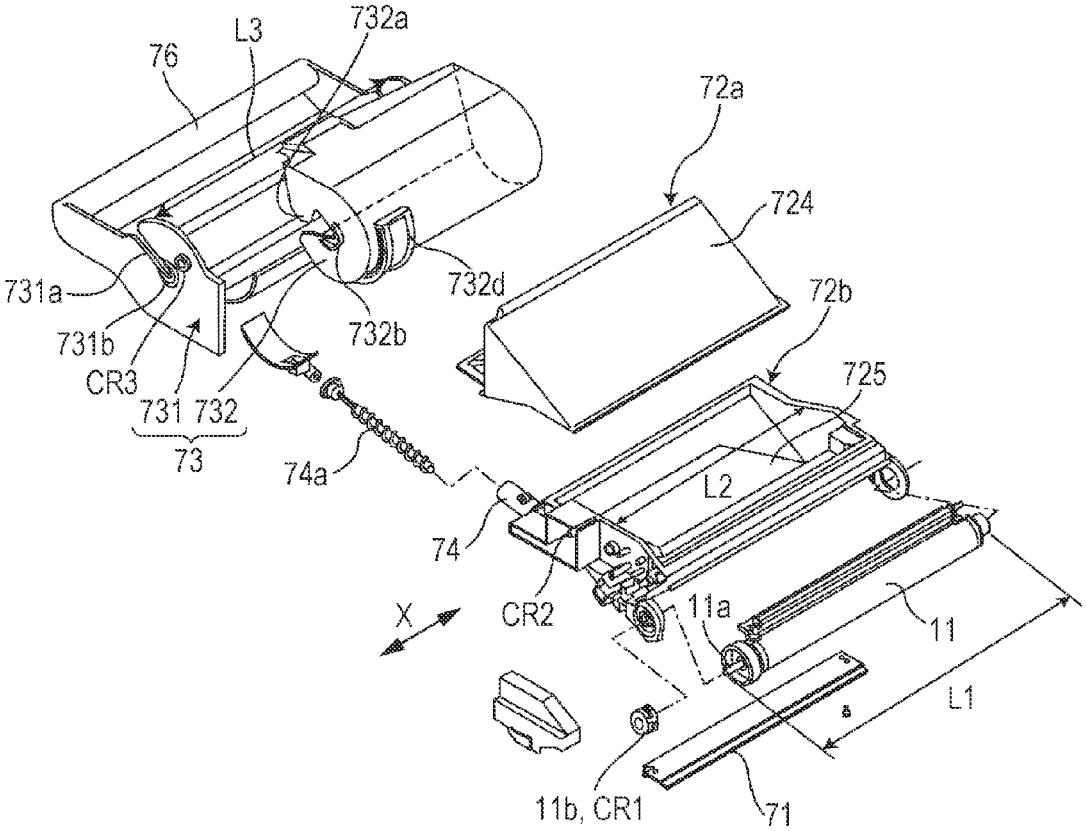
FIG. 7 is an exploded perspective view of the process cartridge.

FIG. 7 is an exploded perspective view of the process cartridge CR. FIG. 7 illustrates some of the components included in the process cartridge CR.

The collected-toner receiving box 72 includes an upper member 72*a* and a lower member 72*b*. The lower member 72*b* is a container-shaped member that is disposed below the upper member 72*a* and that is open at the top side. The lower member 72*b* has a function of supporting the entire structure of the process cartridge CR. The cleaning device 71 and the photoconductor 11 are attached to the lower member 72*b*. In addition, a fixed member 731 included in the container attachment unit 73 and the developing device 13 (see FIG. 5), which is not illustrated in FIG. 7, are also attached to the lower member 72*b*.

The upper member 72*a* is a container-shaped member that is open at the bottom side. The upper member 72*a* is placed on the lower member 72*b* such that the upper member 72*a* functions as a lid. Thus, peripheral portions of the upper member 72*a* and the lower member 72*b* are placed on top of each other except for the area in which the cleaning device 71 is disposed. Thus, the space in which the toner may be contained is defined as illustrated in FIG. 5. A gap for receiving the toner collected by the cleaning device 71 is formed at the area in which the cleaning device 71 is disposed.

The length L1 of the photoconductor 11 in the axial direction X corresponds to the sum of the width of the sheets of paper in the axial direction X, allowance for the displacement of the sheets of paper, and dimensions of bearings 11*b*. The length L2 of the collected-toner receiving box 72 in the axial direction X is set to a maximum length within the range in which the collected-toner receiving box 72 is capable of passing through the attachment opening 91 through which the photoconductor 11 passes when the process cartridge CR is attached to the image forming apparatus 1. In other words, the length L2 is substantially equal to the length L1 of the photoconductor 11. The length L3 of the container attachment unit 73 in the axial direction X is also substantially equal to the length L1 of the photoconductor 11.

Figure 8A:
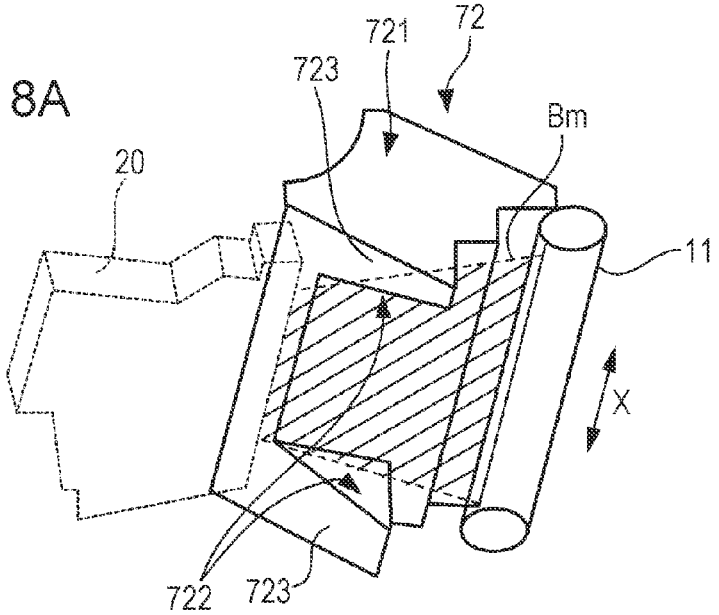
FIGS. 8A and 8B are diagrams illustrating a collected-toner receiving box and a photoconductor included in the process cartridge.
Figure 8B:
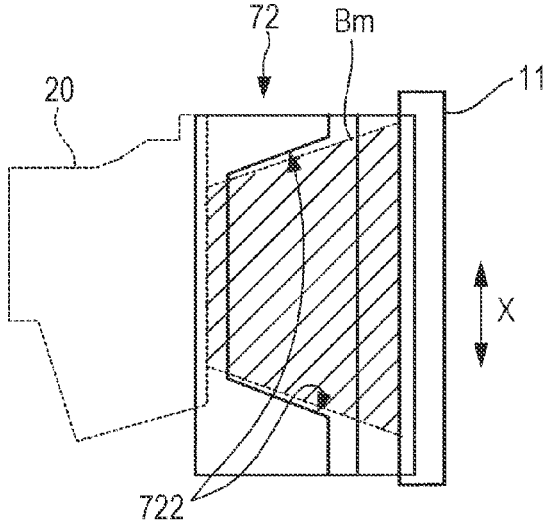

FIGS. 8A and 8B are diagrams illustrating the collected-toner receiving box 72 and the photoconductor 11 included in the process cartridge CR. FIG. 8A is a perspective view of the collected-toner receiving box 72 and the photoconductor 11 as viewed from obliquely below the image forming apparatus. FIG. 8B is a bottom view of the collected-toner receiving box 72 and the photoconductor 11. FIGS. 8A and 8B also illustrate the exposure device 20 and the scanning area scanned with the light beam Bm emitted from the exposure device 20.

Referring to FIGS. 8A, 8B, and 5, the collected-toner receiving box 72 includes a first receiving section 721 that extends in an area above the scanning area of the light beam Bm and a pair of second receiving sections 722 that extend to positions below the scanning area of the light beam Bm. The pair of second receiving sections 722 extend downward from the first receiving section 721 at both sides of the scanning area of the light beam Bm in the axial direction X without partitions provided between the first receiving section 721 and the second receiving sections 722.

The scanning area of the light beam Bm extends in a fan-shape having a center (pivot) thereof in the exposure device 20, and the side of the scanning area near the exposure device 20 is shorter than the side thereof near the photoconductor 11. Therefore, in the area between the photoconductor 11 and the exposure device 20 in the direction in which the light beam Bm is emitted, that is, in the area in which the collected-toner receiving box 72 is disposed, spaces through which the light beam Bm does not pass are provided at both sides of the scanning area of the light beam Bm in the axial direction X. Since the collected-toner receiving box 72 includes the second receiving sections 722 that are placed in the spaces at both sides of the scanning area of the light beam Bm, the capacity of the collected-toner receiving box 72 is increased by the amounts corresponding to the capacities of the second receiving sections 722.

As illustrated in FIG. 8B, each of the second receiving sections 722 is shaped in accordance with the shape of the scanning area of the light beam Bm such that the width thereof in the axial direction X increases as the distance to the exposure device 20 decreases. Since each second receiving section 722 is formed such that the width thereof gradually increases in the area outside the scanning area of the light beam Bm, the capacity of the collected-toner receiving box 72 is increased accordingly.

A bottom wall 723 (see FIGS. 5 and 8A) of each of the two second receiving sections 722 of the collected-toner receiving box 72 and a top wall 724 (see FIGS. 5 and 7) of the collected-toner receiving box 72 extend along planes that extend in the attachment-detachment direction JK of the process cartridge CR. Therefore, compared to the case in which, for example, the top wall or each bottom wall extends in a direction different from the attachment-detachment direction JK, the capacity of the collected-toner receiving box 72 is increased while reducing the possibility that the collected-toner receiving box 72 will unexpectedly come into contact with a part of the apparatus body 1A (see FIG. 1) when the process cartridge CR is attached to or detached from the apparatus body 1A. A raised bottom 725 (see FIGS. 5 and 7) of the first receiving section 721 of the collected-toner receiving box 72 that is disposed above the scanning area of the light beam Bm extends along the scanning area of the light beam Bm. Therefore, compared to the case in which, for example, the raised bottom 725 has an irregular shape, the capacity of the collected-toner receiving box 72 is increased in the area outside the scanning area of the light beam Bm.

In addition, as illustrated in FIG. 1, the bottom of the output table 83 provided on the apparatus body 1A of the image forming apparatus 1 is substantially parallel to the top wall 724 of the collected-toner receiving box 72 that is opposed to the output table 83. In other words, the bottom of the output table 83 extends in the attachment-detachment direction JK. Thus, when the process cartridge CR passes under the output table 83 in the process of attaching or detaching the process cartridge CR to/from the apparatus body 1A, the possibility that the collected-toner receiving box 72 will be caught by the output table 83 may be reduced.

In the process cartridge CR illustrated in FIG. 5, the direction perpendicular to both the attachment-detachment direction JK of the process cartridge CR and the axial direction X is defined as a thickness direction T. The height h1 of the collected-toner receiving box 72 in the thickness direction T, that is, the height h1 between each bottom wall 723 and the top wall 724, is substantially equal to the height (thickness) h2 of the container attachment unit 73, to which the toner container TC is attached, in the thickness direction T. The height (thickness) h3 of the toner-image forming unit 10 in the thickness direction T is smaller than the thickness h1 of the collected-toner receiving box 72. Accordingly, the dimension of the attachment opening 91 (see FIG. 1), through which the process cartridge CR including the large-capacity collected-toner receiving box 72 passes, in the thickness direction T may be set to a dimension necessary for allowing the toner container TC to be attached to or detached from the container attachment unit 73.

Toner Container and Container Attachment Unit

Figure 9:
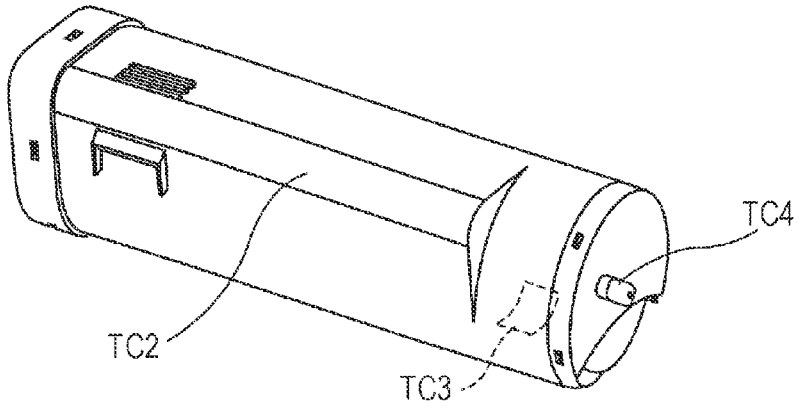
FIG. 9 is a perspective view of a toner container that is attachable to the process cartridge illustrated in FIG. 5.

FIG. 9 is a perspective view of the toner container TC that is attachable to the process cartridge CR illustrated in FIG. 5.

The toner container TC illustrated in FIG. 9 has a cylindrical shape with closed ends, and is provided with a projecting portion TC2 that shows the position of the toner container TC on a part of the peripheral surface of the toner container TC. A door TC3 that covers an opening that allows the toner to pass therethrough is provided at the peripheral surface of the toner container TC. In addition, a projection TC4 is provided on a circular side surface of the toner container TC. The toner container TC is attachable to the container attachment unit 73 illustrated in FIG. 5. FIG. 5 illustrates the state in which the toner container TC is attached to the container attachment unit 73.

The container attachment unit 73 will now be described with reference to the exploded view of FIG. 7 again. The container attachment unit 73 includes the fixed member 731 that is fixed to the collected-toner receiving box 72 and a restraining member 732 that restrains the toner container TC with respect to the fixed member 731 in response to a certain operation.

The fixed member 731 includes a container-guiding cut portion 731*a* that linearly extends to guide the projection TC4 on the toner container TC and an arc-shaped restraining-portion-guiding hole 731*b* that guides the restraining member 732 while holding the restraining member 732. The handle 76 is fixed to the fixed member 731.

The restraining member 732 has a cylindrical shape with closed ends and a peripheral surface that is partially cut out, and is rotatably retained by the fixed member 731. The toner container TC is placed in the restraining member 732. A projection 732*b* that is fitted to the restraining-portion-guiding hole 731*b* in the fixed member 731 is formed on a side surface of the cylindrical restraining member 732. An opening-closing piece 732*a* that opens or closes the container-guiding cut portion 731*a* in the fixed member 731 is provided at the side surface of the restraining member 732. A door engagement portion 732*d* that engages with the door TC3 of the toner container TC is provided on the peripheral surface of the restraining member 732.

Figure 10:
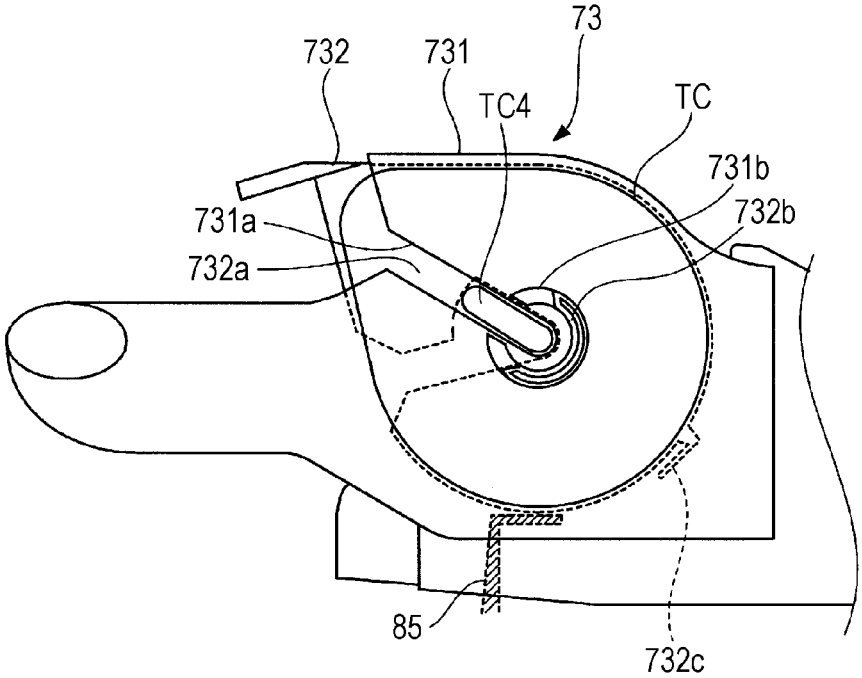
FIG. 10 is a diagram illustrating a container attachment unit in a see-through manner.

FIG. 10 is a diagram illustrating the container attachment unit 73 in a see-through manner. FIG. 10 shows the state in which the toner container TC is attached to the container attachment unit 73. The projection 732*b* on the restraining member 732 is fitted to the restraining-portion-guiding hole 731*b* in the fixed member 731, and is retained such that the projection 732*b* is movable along the arc shape of the restraining-portion-guiding hole 731*b*. Thus, the restraining member 732 is rotatably retained by the fixed member 731.

The projection TC4 on the toner container TC is placed in the container-guiding cut portion 731*a* in the fixed member 731. In the state illustrated in FIG. 10, the container-guiding cut portion 731*a* is closed by the opening-closing piece 732*a* of the restraining member 732. Thus, the toner container TC is set to a locked state in which the toner container TC cannot be taken out from the container attachment unit 73. In the locked state illustrated in FIG. 10, the door TC3 (see FIG. 9) of the toner container TC is engaged with the door engagement portion 732*d* of the restraining member 732 and is set to an open state. Accordingly, the toner in the toner container TC may be supplied to the toner supplier 74 (see FIG. 1).

The restraining member 732 includes a retaining piece 732*c* that is engageable with a retaining portion 85 provided on the apparatus body 1A (see FIG. 1) of the image forming apparatus 1. However, in the locked state illustrated in FIG. 10, the retaining piece 732*c* of the restraining member 732 is not engaged with the retaining portion 85 on the apparatus body 1A (see FIG. 1). Therefore, in the locked state, the process cartridge CR (see FIG. 1) may be taken out from the apparatus body 1A (see FIG. 1) of the image forming apparatus 1.

Figure 11:
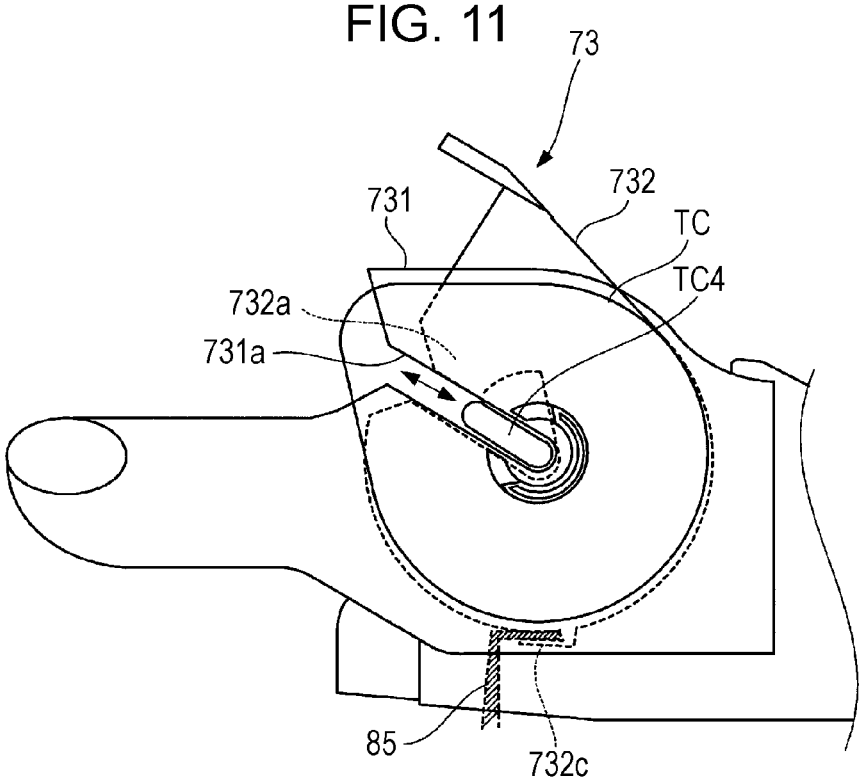
FIG. 11 is a diagram illustrating the state in which the toner container is unlocked in a see-through manner.

FIG. 11 is a diagram illustrating the state in which the toner container TC is unlocked in a see-through manner.

When the operator rotates the restraining member 732 in the locked state illustrated in FIG. 10, the opening-closing piece 732*a* of the restraining member 732 is removed from the container-guiding cut portion 731*a*, so that the container-guiding cut portion 731*a* is set to an open state. In this state, the projection TC4 of the toner container TC may be moved out of the container-guiding cut portion 731*a*. In other words, the toner container TC is set to an unlocked state in which the toner container TC may be taken out from the container attachment unit 73. In this state, the door TC3 (see FIG. 9) of the toner container TC is set to a closed state by the restraining member 732, and the toner contained in the toner container TC is prevented from leaking to the outside. When the restraining member 732 is rotated to a position where the unlocked state is established, the retaining piece 732*c* on the restraining member 732 engages with the retaining portion 85 on the apparatus body 1A (see FIG. 1). Therefore, in the unlocked state, the process cartridge CR (see FIG. 1) cannot be taken out from the apparatus body 1A (see FIG. 1) of the image forming apparatus 1. Thus, one of the unlocked state illustrated in FIG. 11 in which the toner container TC may be taken out and the locked state illustrated in FIG. 10 in which the process cartridge CR (see FIG. 1) may be taken out from the apparatus body 1A (see FIG. 1) of the image forming apparatus 1 is exclusively selectable in response to the operation of the restraining member 732. Therefore, when the toner container TC is taken out, the process cartridge CR is prevented from being taken out unexpectedly or displaced.

Positioning of Process Cartridge

Figure 12:
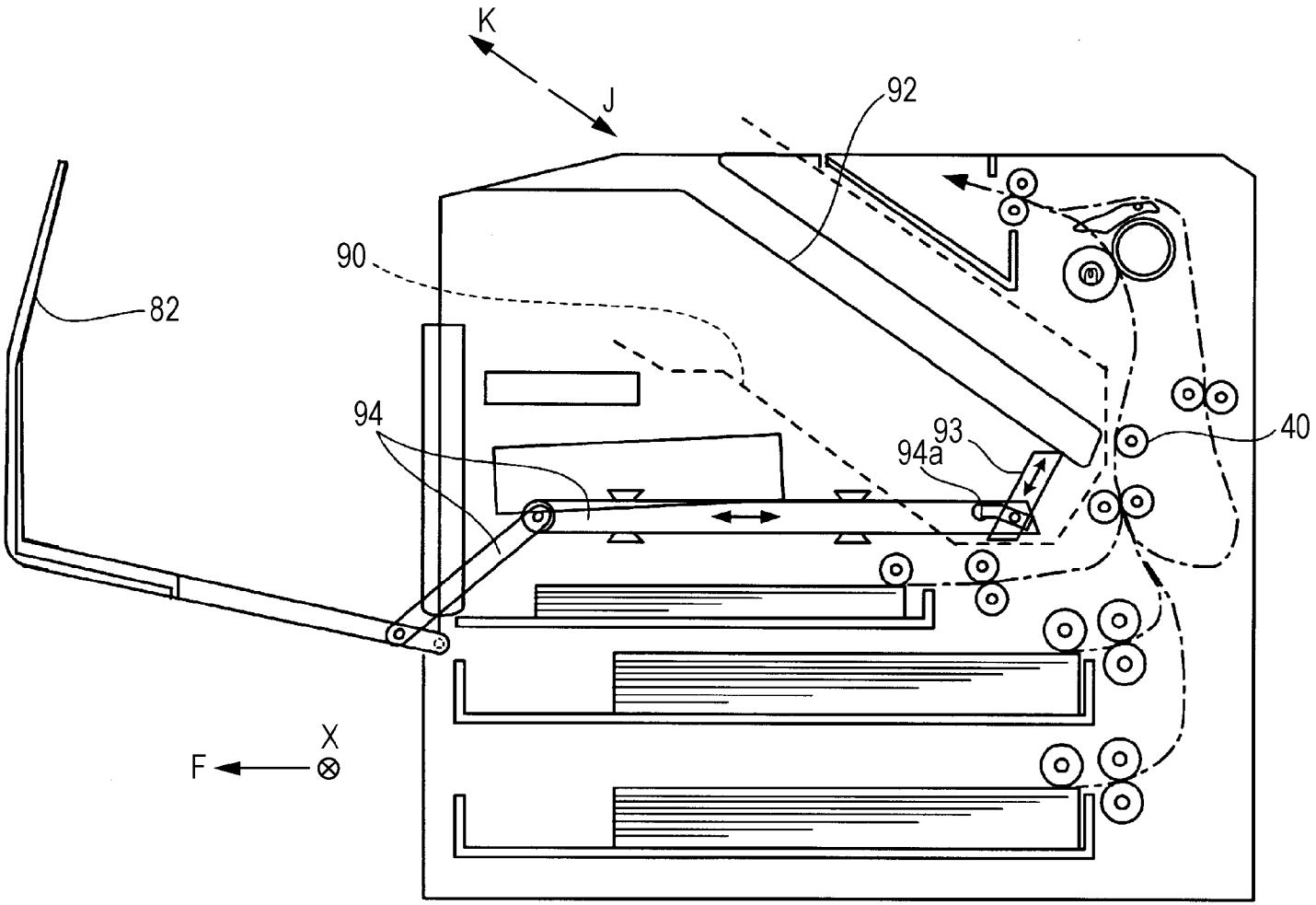
FIG. 12 is a sectional view illustrating the state in which the process cartridge is removed from the image forming apparatus illustrated in FIG. 1.

FIG. 12 is a sectional view illustrating the state in which the process cartridge CR is removed from the image forming apparatus 1 illustrated in FIG. 1. FIG. 12 illustrates the apparatus body 1A of the image forming apparatus 1 from which the process cartridge CR (see FIG. 1) is removed.

The apparatus body 1A of the image forming apparatus 1 includes the attachment unit 90 to which the process cartridge CR is attached. The attachment unit 90 includes a hollow space that extends in the attachment direction J from a position in the upper section of the image forming apparatus 1 near the side thereof in the forward direction F to the transferring device 40. When the door panel 82 is opened, the attachment unit 90 of the image forming apparatus 1 is externally exposed. Each of the walls at both sides of the attachment unit 90 in the axial direction X has a guiding groove 92 that extends in the attachment-detachment direction JK. At each side of the attachment unit 90 in the image forming apparatus 1, the guiding groove 92 extends to the position where the bearing of the photoconductor 11 is disposed.

The attachment unit 90 in the apparatus body 1A also includes a blocking member 93 and a blocking-member driver 94 at each side thereof. The blocking member 93 blocks the guiding groove 92 at an intermediate position thereof. The blocking-member driver 94 moves the blocking member 93 in response to the opening-closing movement of the door panel 82. The blocking-member driver 94 is connected to the door panel 82 at one end thereof, and has a crank mechanism that converts a rotating movement of the door panel 82 into a movement in the forward direction F or the rearward direction B. In addition, the blocking-member driver 94 has a cam groove 94*a* that operates the blocking member 93 in response to the movement of the blocking-member driver 94. When the door panel 82 is closed, the blocking-member driver 94 moves in the rearward direction B, and the blocking member 93 is operated by the cam groove 94*a* in the blocking-member driver 94 so as to move to the position where the blocking member 93 blocks the guiding groove 92.

Figure 13:
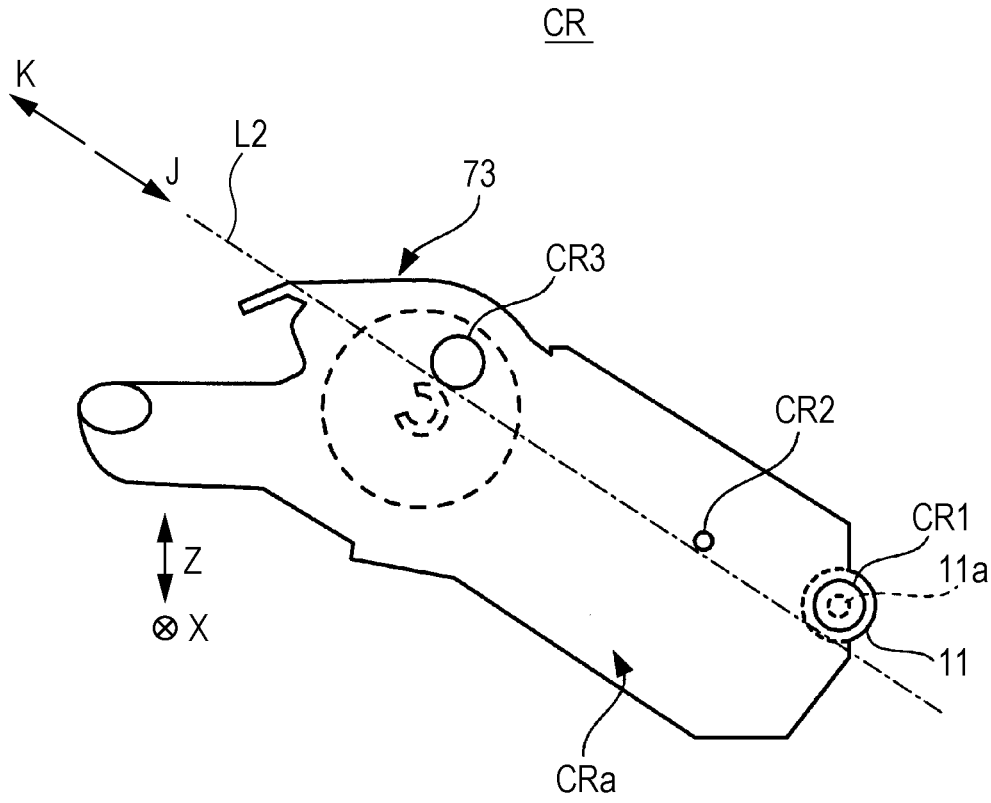
FIG. 13 is a diagram illustrating a side surface of the process cartridge.

FIG. 13 is a diagram illustrating a side surface of the process cartridge CR. FIG. 13 illustrates the external shape of the process cartridge CR.

Three projections CR1, CR2, and CR3 that project in the axial direction X are provided on each side surface CRa of the process cartridge CR in the axial direction X. FIG. 13 illustrates the three projections CR1 to CR3 provided on one side surface CRa of the two side surfaces at both sides of the process cartridge CR. The three projections CR1, CR2, and CR3 have a cylindrical shape. Of the three projections CR1 to CR3, the first projection CR1 is formed integrally with the bearing 11*b* (see FIG. 7) that supports a rotating shaft 11*a* of the photoconductor 11. The third projection CR3 projects at a position corresponding to the container attachment unit 73. The first projection CR1 and the third projection CR3 have a diameter that is substantially the same as the width of the guiding groove 92 formed in the apparatus body 1A of the image forming apparatus 1, so that the first projection CR1 and the third projection CR3 may move along the guiding groove 92 without rattling. The first projection CR1 and the third projection CR3 are arranged in the attachment-detachment direction JK. The second projection CR2 is disposed between the first projection CR1 and the third projection CR3, and has a diameter smaller than that of the first projection CR1 and the third projection CR3. More specifically, the diameter of the second projection CR2 is smaller than the width of the guiding groove 92. When the second projection CR2 is placed in the guiding groove 92, a gap larger than the diameter of the second projection CR2 is provided between the second projection CR2 and the guiding groove 92. The second projection CR2 touches a tangent line L2 at the upper side thereof, the tangent line L2 being one of common tangent lines of the first projection CR1 and the third projection CR3 that is at the lower position in the direction of gravity Z. In other words, the three projections CR1 to CR3 are positioned to have a common tangent line L2.

Figure 14:
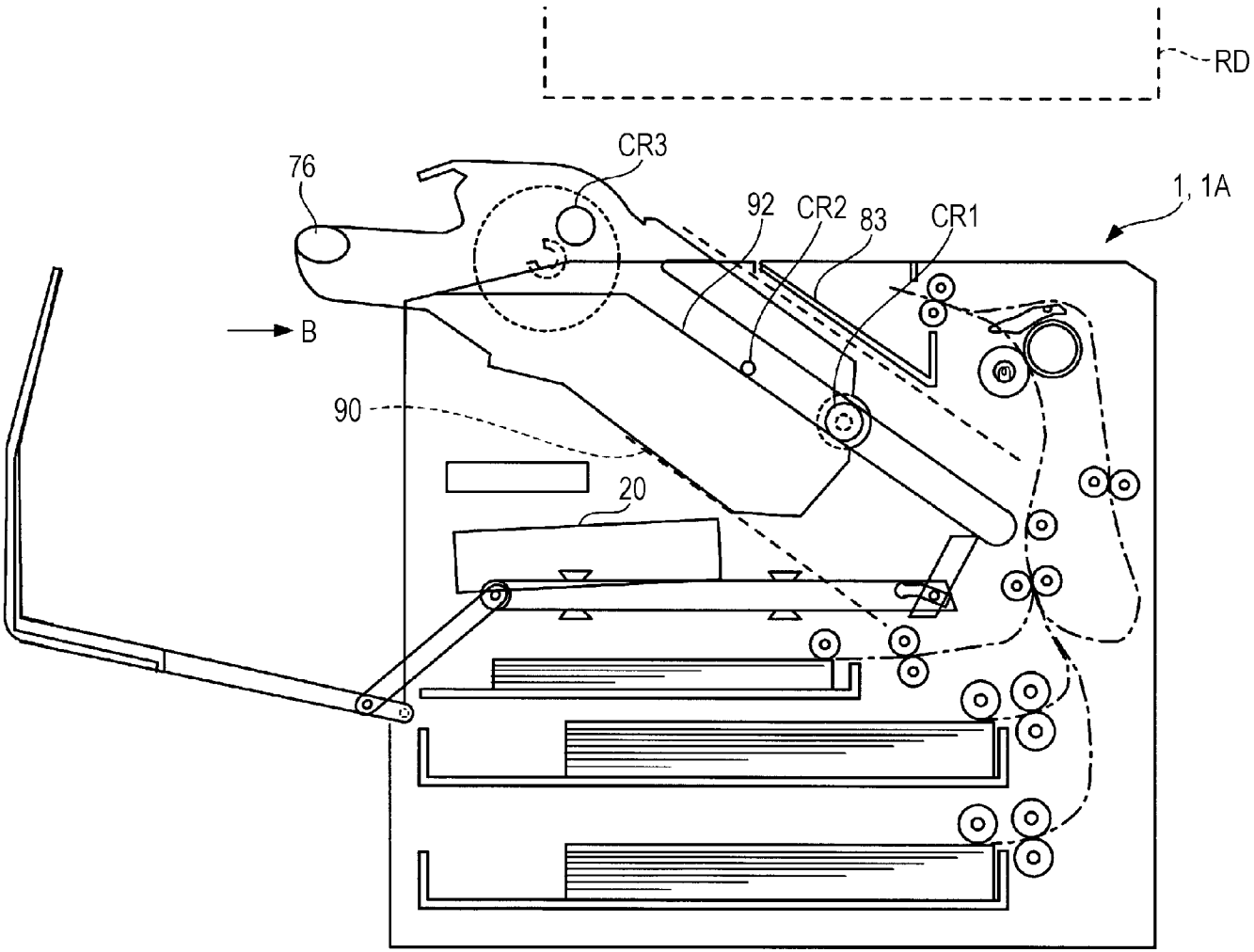
FIG. 14 is a diagram illustrating an intermediate state of a process of attaching the process cartridge to the apparatus body of the image forming apparatus.

FIG. 14 is a diagram illustrating an intermediate state of a process of attaching the process cartridge CR to the apparatus body 1A of the image forming apparatus 1.

In the process of attaching the process cartridge CR to the apparatus body 1A of the image forming apparatus 1, the operator grasps the handle 76 of the process cartridge CR with one hand and supports the process cartridge CR with the other hand at around the bottom walls 723 (see FIG. 5) of the collected-toner receiving box 72. Thus, the operator holds the process cartridge CR in the position illustrated in FIG. 14. Then, the operator places the first projection CR1 on the process cartridge CR into the guiding groove 92 at each side of the apparatus body 1A, and moves the process cartridge CR in the attachment direction J while grasping the handle 76. Accordingly, the first projection CR1 moves along the guiding groove 92, and the process cartridge CR is inserted into the attachment unit 90 in the apparatus body 1A (see FIG. 4). An end portion of the process cartridge CR passes through an area above the exposure device 20 and an area below the output table 83. The third projection CR3 enters the guiding groove 92 before the entire body of the process cartridge CR is placed in the attachment unit 90 in the apparatus body 1A. Thus, the position of the process cartridge CR is fixed. The second projection CR2 enters the guiding groove 92 before the third projection CR3 enters the guiding groove 92, more specifically, before the lower end of the process cartridge CR passes through an area above the upper end of the exposure device 20. Since the diameter of the second projection CR2 is smaller than the width of the guiding groove 92, the second projection CR2 does not contribute to the positioning of the process cartridge CR. However, when the second projection CR2 is placed in the guiding groove 92, the process cartridge CR is prevented from rotating around the first projection CR1 and being lowered. Therefore, in the process of attaching or detaching the process cartridge CR to/from the apparatus body 1A, the process cartridge CR is prevented from coming into contact with the exposure device 20 and affecting the accuracy of the exposure device 20. Since the diameter of the second projection CR2 is smaller than the width of the guiding groove 92, the process cartridge CR may be somewhat raised upward from the position illustrated in FIG. 14.

Figure 15:
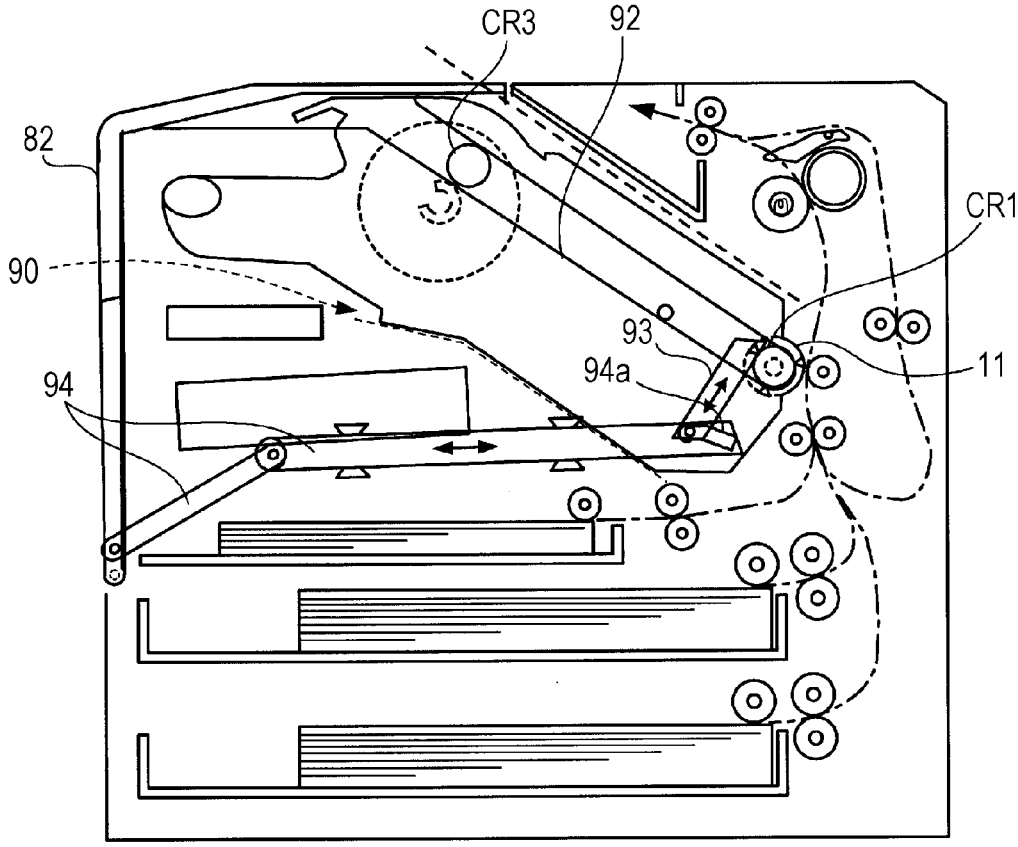
FIG. 15 is a diagram illustrating the state in which the process cartridge is attached to the apparatus body of the image forming apparatus.

FIG. 15 is a diagram illustrating the state in which the process cartridge CR is attached to the apparatus body 1A of the image forming apparatus 1. FIG. 15 illustrates components relating to the attachment unit 90 in the image forming apparatus 1 illustrated in FIG. 1.

In the state in which the entire body of the process cartridge CR is placed in the apparatus body 1A of the image forming apparatus 1, the first projection CR1 and the second projection CR2 on the process cartridge CR are placed in the guiding groove 92 at each side of the apparatus body 1A, and the position of the process cartridge CR is fixed. The first projection CR1 is in contact with the distal end portion of the guiding groove 92, and is stopped.

When the door panel 82 is closed, the blocking member 93 is moved to the position where the blocking member 93 blocks the guiding groove 92, owing to the movement of the blocking-member driver 94 and the engagement between the blocking member 93 and the cam groove 94*a*. At this time, the blocking member 93 comes into contact with the first projection CR1. Accordingly, the first projection CR1 is positioned by the guiding groove 92 and the blocking member 93 at three points shown by triangular marks. The blocking member 93 prevents the process cartridge CR that has been attached to the apparatus body 1A from being displaced. In addition, since the first projection CR1 is integrated with the bearing 11*b* (see FIG. 7) that supports the rotating shaft 11*a* of the photoconductor 11 at each side of the apparatus body 1A, the photoconductor 11 is precisely positioned in the apparatus body 1A at the above-described three points. The accuracy of the position of the photoconductor 11 with respect to the transferring device 40 directly affects the image quality of the image that is formed. In the image forming apparatus according to the present exemplary embodiment, compared to the case in which, for example, positioning using the above-described three points is not provided, the image quality may be increased.

In the above-described exemplary embodiment, the toner-image forming unit 10 including the photoconductor 11, the charging device 12, and the developing device 13 is described as an example of an image forming unit according to an exemplary embodiment of the present invention. However, the present invention is not limited to this, and the image forming unit may further include, for example, a transferring device and a fixing device.

In addition, in the above-described exemplary embodiment, the collected-toner receiving box 72 including the upper member 72*a* and the lower member 72*b* is described as an example of a toner receiving box according to an exemplary embodiment of the present invention. However, the present invention is not limited to this, and the toner receiving box may include, for example, three or more components.

In addition, in the above-described exemplary embodiment, the photoconductor 11 having a cylindrical surface is described as an example of an image carrier according to an exemplary embodiment of the present invention. However, the present invention is not limited to this, and the image carrier may be, for example, belt-shaped.

In addition, in the above-described exemplary embodiment, a plate-shaped blade is described as an example of a cleaning device according to an exemplary embodiment of the present invention. However, the present invention is not limited to this, and the cleaning device may be, for example, a brush.

In addition, in the above-described exemplary embodiment, the structure in which the toner image on the photoconductor 11 is directly transferred onto a sheet of paper is described as an example of an image forming unit according to an exemplary embodiment of the present invention. However, the present invention is not limited to this, and the toner image on the image carrier may, for example, be transferred onto an intermediate transfer body and then indirectly transferred onto a sheet of paper.

In addition, in the above-described exemplary embodiment, a sheet of paper is described as an example of a transfer body according to an exemplary embodiment of the present invention. However, the present invention is not limited to this. The transfer body is not limited as long as the transfer body is a recording medium on which an image may be formed, and may be, for example, a resin sheet.

In addition, in the above-described exemplary embodiment, a monochrome printer is described as an example of an image forming apparatus. However, the image forming apparatus according to the present invention is not limited to this, and may instead be, for example, a color printer that forms color images.

In addition, in the above-described exemplary embodiment, a printer is described as an example of an image forming apparatus. However, the image forming apparatus according to the present invention is not limited to this, and may instead be, for example, a copy machine or a facsimile machine.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A process cartridge comprising:

an image forming unit including an image carrier that carries a latent image formed by an exposure process and a toner image formed by developing the latent image with toner, the image carrier transferring the toner image onto a transfer body, a developing unit that forms the toner image on the image carrier by developing the latent image on the image carrier with the toner, and a cleaning unit that cleans the image carrier by removing the toner that remains on the image carrier after the toner image is transferred onto the transfer body;

a container attachment unit that is provided at a position separated from the image forming unit and to which a toner container is detachably attached, the toner container containing the toner to be supplied to the developing unit; and a toner receiving unit that extends in a space between the image forming unit and the container attachment unit and receives the toner removed from the image carrier by the cleaning unit, wherein the image carrier rotates around a rotational axis that extends transversely, and the latent image is formed on the image carrier by scanning the image carrier with a light beam in a transverse direction, and wherein the toner receiving unit includes a first receiving section that extends in an area above a scanning area of the light beam and a pair of second receiving sections that extend from the first receiving section to positions below the scanning area of the light beam at both sides of the scanning area of the light beam without partitions provided between the first and second receiving sections.

2. The process cartridge according to claim 1, wherein the image forming unit, the toner receiving unit, and the container attachment unit are arranged in a direction in which the process cartridge is attached to or detached from a cartridge attachment unit.

3. The process cartridge according to claim 1, wherein the process cartridge is attached to a cartridge attachment unit such that the container attachment unit is at a trailing end of the process cartridge in a direction in which the process cartridge is attached to the cartridge attachment unit.

4. The process cartridge according to claim 1, wherein the toner receiving unit includes an upper wall and a lower wall that extend in a direction in which the process cartridge is attached to or detached from a cartridge attachment unit.

5. An image forming apparatus comprising:

a process cartridge comprising:

an image forming unit including an image carrier that carries a latent image formed by an exposure process and a toner image formed by developing the latent image with toner, the image carrier transferring the toner image onto a transfer body, a developing unit that forms the toner image on the image carrier by developing the latent image on the image carrier with the toner, and a cleaning unit that cleans the image carrier by removing the toner that remains on the image carrier after the toner image is transferred onto the transfer body;

a container attachment unit that is provided at a position separated from the image forming unit and to which a toner container is detachably attached, the toner container containing the toner to be supplied to the developing unit;

a toner receiving unit that extends in a space between the image forming unit and the container attachment unit and receives the toner removed from the image carrier by the cleaning unit;

a cartridge attachment unit to which the process cartridge is detachably attached;

an exposure unit that subjects the image carrier included in the process cartridge attached to the cartridge attachment unit to the exposure process for forming the latent image on the image carrier;

a transporting unit that transports the transfer body along a transporting path that passes through a position at which the image carrier transfers the toner image onto the transfer body; and a fixing unit that fixes the toner image that has been transferred onto the transfer body by the image carrier to the transfer body, wherein the image carrier rotates around a rotational axis that extends transversely, and the exposure unit forms the latent image on the image carrier by scanning the image carrier with a light beam in a transverse direction, and wherein the toner receiving unit includes a first receiving section that extends in an area above a scanning area of the light beam and a pair of second receiving sections that extend from the first receiving section to positions below the scanning area of the light beam at both sides of the scanning area of the light beam without partitions provided between the first and second receiving sections.

6. The image forming apparatus according to claim 5, wherein the image forming unit, the toner receiving unit, and the container attachment unit included in the process cartridge are arranged in a direction in which the process cartridge is attached to or detached from the cartridge attachment unit.

7. The image forming apparatus according to claim 6, wherein the process cartridge is attached to the cartridge attachment unit such that the container attachment unit is at a trailing end of the process cartridge in the direction in which the process cartridge is attached to the cartridge attachment unit.

8. The image forming apparatus according to claim 5, wherein the toner receiving unit includes an upper wall and a lower wall that extend in a direction in which the process cartridge is attached to or detached from the cartridge attachment unit.

9. A process cartridge comprising:

an image forming unit comprising an image carrier that carries a latent image formed by an exposure process, a developing unit that forms a toner image by developing the latent image on the image carrier, and a cleaning unit that removes toner from the image carrier after the toner image is transferred from the image carrier to a transfer body;

a container attachment unit that is provided at a position separated from the image forming unit and to which a toner container is detachably attached, the toner container supplying toner to the developing unit of the image forming unit; and a toner receiving unit that extends in a space between the image forming unit and the container attachment unit, and that receives the toner removed from the image carrier by the cleaning unit, wherein, in the exposure process, a light beam exposes the image carrier by scanning the image carrier in a transverse direction along a rotational axis of the image carrier, and wherein a portion of the toner receiving unit extends below a scanning area of the light beam in a direction orthogonal to the transverse direction.

10. The process cartridge according to claim 9, wherein the portion of the toner receiving unit extends below the scanning area on both sides of the scanning area.

11. The process cartridge according to claim 10, wherein the toner receiving unit comprises a first receiving section that extends in an area above the scanning area of the light beam, and two second receiving sections that extend from the first receiving portion orthogonal to the first receiving section.

* * * * *